US005343840A

United States Patent [19]

Wataya et al.

[11] Patent Number: 5,343,840

[45] Date of Patent: Sep. 6, 1994

[54] FAIL-SAFE INTAKE AIR FLOW CONTROL SYSTEM FOR INTERNAL COMBUSTION ENGINE

[75] Inventors: Seiji Wataya; Yukinobu Nishimura; Nobutake Taniguchi, all of Himeji, Japan

[73] Assignee: Mitsubishi Denki Kabushiki Kaisha, Tokyo, Japan

[21] Appl. No.: 54,140

[22] Filed: Apr. 30, 1993

[30] Foreign Application Priority Data

May 7, 1992 [JP] Japan ..... 4-114709

[51] Int. Cl.[5] ..... F02D 9/00

[52] U.S. Cl. ..... 123/399; 123/339; 123/479

[58] Field of Search ..... 123/198 D, 336, 339, 123/399, 396, 585, 361, 479

[56] References Cited

U.S. PATENT DOCUMENTS

| | | | |
|---|---|---|---|
| 4,335,689 | 6/1982 | Abe et al. | 123/336 |
| 4,875,456 | 10/1989 | Tomisawa | 123/339 |
| 4,895,118 | 1/1990 | Nakamura | 123/339 |
| 4,960,087 | 10/1990 | Junginger et al. | 123/339 |
| 5,251,597 | 10/1993 | Smith et al. | 123/585 |

FOREIGN PATENT DOCUMENTS

| | | |
|---|---|---|
| 8441 | 1/1986 | Japan . |
| 113524 | 5/1989 | Japan . |
| 267542 | 11/1991 | Japan . |

*Primary Examiner*—E. Rollins Cross
*Assistant Examiner*—Thomas N. Moulis
*Attorney, Agent, or Firm*—Sughrue, Mion, Zinn, Macpeak and Seas

[57] ABSTRACT

An intake air flow control system for an internal combustion engine of a motor vehicle comprises an accelerator pedal depression sensor for detecting depression depth of an accelerator pedal, a throttle actuator for regulating opening degree of a throttle valve in dependence on the depression depth of the accelerator pedal, a bypass intake passage which bypasses an intake pipe at a location where the throttle valve is disposed, a bypass control valve installed in the bypass intake passage, an abnormality detector for detecting abnormality of control of the throttle actuator, and a controller for controlling the opening degree of the bypass control valve in dependence on depression depth of the accelerator pedal in response to detection of abnormality of in the control performed through the throttle actuator. Operation of the engine can be fail-safed even upon occurrence of failure in the throttle control system in the fully closed state of the throttle valve.

5 Claims, 7 Drawing Sheets

FAIL-SAFE INTAKE AIR FLOW CONTROL SYSTEM FOR INTERNAL COMBUSTION ENGINE

BACKGROUND OF THE INVENTION

Field of the Invention

The present invention relates generally to a system for controlling the flow rate of intake air in an internal combustion engine for a motor vehicle by controlling electrically a throttle valve. More particularly, the invention is concerned with an apparatus for fail-safing the intake air flow control system.

Description of the Related Art

The intake air flow fed to a gasoline engine is conventionally regulated by a throttle valve whose opening is controlled by means of an accelerator pedal mechanically interlocked with the valve. In recent years, however, there is adopted in some practical applications a so-called wired intake air flow control system in which the opening of the throttle valve is controlled by an electrical actuator in response to an output signal of an accelerator pedal position sensor which signal represents depth of depression of an accelerator pedal of a motor vehicle, in an effort to enhance the comfortableness in driving the motor vehicle and realize a driving at a cruising speed, while improving a disposition layout of engine accessories.

For a better understanding of the present invention, the background technique thereof will be described in some detail.

FIG. 2 shows generally and schematically a structure of an intake air flow control system for an internal combustion engine (hereinafter also referred to simply as the engine) of a motor vehicle known heretofore. Referring to the figure, the engine denoted by a reference numeral 1 is equipped with an intake pipe 14 in which a throttle valve 2 is installed for controlling or adjusting the amount or quantity of air supplied to the engine. The throttle valve 2 is mechanically coupled to an electrical throttle actuator 3 which may be constituted by a DC motor, a stepping motor or the like for actuating the throttle valve 2. To this end, the throttle valve 2 is connected to the throttle actuator 3 by means of a shaft 4. A return spring 5 is wound around the shaft 4 in such disposition that the throttle valve 2 is resiliently urged toward the closed position when operation of the throttle actuator 3 is disabled. Provided in association with the throttle valve 2 is a throttle position sensor (TPS) 6 for detecting the degree of opening of the throttle valve 2. On the other hand, there is provided in association with an accelerator pedal 7 of a motor vehicle an accelerator pedal position sensor (APS) 8 which serves for detecting the degree or depth of depression (actuation level) of the accelerator pedal 7. A reference numeral 9 denotes an engine rotation speed sensor for detecting the rotation speed (rpm) of the engine 1 to thereby generate an engine rotation speed signal. The output signals of the sensors 6, 8 and 9 mentioned above are inputted to a controller 10 which is designed to control operation of the throttle actuator 3 on the basis of the sensor output signals.

With the intake air flow control system of the structure described above, the control of the throttle actuator 3 is realized through a procedure which is illustrated in a flow chart of FIG. 3. Incidentally, processings and operations such as arithmetic operations, conditional decisions and others for the aimed control described below by reference to FIG. 3 and others are executed by a micro-computer incorporated in the controller 10. However, since such micro-computer is a conventional one, description thereof is omitted, being understood that implementation as well as programming of the micro-computer lies within the skill of those having ordinary knowledge in the art.

Now, referring to FIG. 3, in a step 100, the controller 10 or micro-computer incorporated therein fetches the output signal of the accelerator pedal position sensor 8, which signal represents a degree of depression $\alpha$ of the accelerator pedal 7. In a step 101, a desired opening degree $\theta_s$ of the throttle valve 2 is arithmetically determined on the basis of the detected depression depth $\alpha$ of the accelerator pedal 7 and the engine speed (rpm) Ne indicated by the output signal of the engine speed sensor 9. The arithmetic operation for determining the throttle opening $\theta_s$ can be performed in accordance with a predetermined function which represents a relation between the desired throttle opening $\theta_s$ and the accelerator pedal depression a by taking into consideration the engine speed Ne as a correcting quantity.

The relation between the desired throttle valve opening degree $\theta_s$ and the accelerator pedal depression depth $\alpha$ may differ in dependence on maneuvering performances or characteristics to be imparted to the motor vehicle. FIG. 4 graphically illustrates a typical one of such relations. Referring to the figure, a characteristic curve a in solid line indicates that the throttle opening degree $\theta_s$ is changed substantially linearly in proportion to the depression $\alpha$ of the accelerator pedal. In contrast, in the case represented by a characteristic curve b, the throttle valve opening $\theta_s$ is so controlled as to change gently in a range within which the accelerator pedal depression $\alpha$ remains small. With the maneuvering characteristic represented by the curve b, it is contemplated to cope with such problems that shock is likely to occur in the motor vehicle, making difficult the optimum control of the engine, when the intake air flow changes rapidly or steeply upon starting of the vehicle or in the course of running at a low speed.

On the other hand, FIG. 5 graphically illustrates relations between the engine output torque and the engine rotation speed (rpm). As can be seen from a broken-line curve labeled "ENGINE TORQUE", the output torque of the engine does not bear a linear relationship to the engine rotation speed (rpm). More specifically, in low- and high-speed ranges, the engine output torque tends to become low. In this conjunction, it is to be mentioned that the above-mentioned dependence of the engine output torque on the engine rotation speed ranges can be improved by correcting the relation represented by the curve b shown in FIG. 4 with correcting coefficients or quantities represented by a solid-line curve shown in FIG. 5 and labeled "CORRECTING COEFFICIENTS". At this juncture, it should also be mentioned that the control characteristic of the throttle opening degree $\theta_s$ relative to the accelerator pedal depression $\alpha$ described above is only for the purpose of illustration. In reality, such control characteristics may vary in dependence on the desired maneuverability, comfortableness in driving the motor vehicle and/or other factors as well as performances of the engine.

After having determined the desired throttle opening degree $\theta_s$ as mentioned above, the processing proceeds to a step 102 (FIG. 3) in which a real or actual throttle opening degree $\theta_r$ is fetched from the output of the throttle position sensor 6, which is then followed by a step 103 where a deviation or difference e between the desired throttle opening degree $\theta_s$ and the real throttle opening degree $\theta_r$ is arithmetically determined. When the real throttle opening degree $\theta_r$ is smaller than the desired throttle opening $\theta_s$, the throttle valve 2 is driven in the direction to increase the throttle opening $\theta_r$ on the basis of the deviation e through the throttle actuator 3 in a step 104*a*. If otherwise, the throttle valve 2 is driven in the direction to decrease the throttle opening $\theta_r$ through the throttle actuator 3 in a step 104*b*.

By controlling the opening degree of the throttle valve 2 through the electrical throttle actuator 3 in this manner, a high controllability of the engine operation and hence a high maneuverability of the motor vehicle can be realized. However, in contrast to the conventional mechanical control of the throttle valve in which the opening degree thereof is controlled by the accelerator pedal through the medium of a mechanical linkage, the electrical control of the throttle valve 2 described above is susceptible to a problem that the throttle valve 2 may become inoperative, when a failure occurs in the throttle actuator 3, the controller 10 or other components taking parts in the electrical control of the throttle valve 2, as a result of which uncontrollable running or runaway of the motor vehicle will be incurred. Accordingly, it is very important to fail-safe the electrical control of the throttle valve mentioned above.

FIG. 6 is a flow chart for illustrating, by way of example, a procedure known heretofore for making decision as to occurrence of abnormality in the control system for the throttle valve 2 inclusive of the throttle actuator 3 together with the measures to be taken in dependence on the results of the abnormality decision. Referring to the figure, in a step 200, difference $\beta$ between the desired opening degree $\theta_s$ of the throttle valve which can be derived on the basis of the depression $\alpha$ of the accelerator pedal 7 and the real opening degree $\theta_r$ of the throttle valve is determined. In this conjunction, it is noted that the relation between the quantities $\alpha$ and $\theta_r$ can be given by a predetermined function, as described above. So long as the relation given by this function remains normal, there can not make appearance the difference $\beta$ of such magnitude which exceeds a predetermined value $\beta_1$. In other words, it can be decided that the real throttle opening $\theta_r$ is abnormal when the above-mentioned difference $\beta$ exceeds the predetermined value $\beta_1$. When it is determined in a step 201 that the difference $\beta$ is greater than the preset value $\beta_1$, electric power supply to the throttle actuator 3 is interrupted to thereby stop the operation of the throttle actuator 3 in a step 202*b*, because, if otherwise, there arises possibility of runaway of the motor vehicle due to the abnormality occurring in the throttle valve or in the control system therefor. On the other hand, when the difference $\beta$ is smaller than the preset value $\beta_1$, this means that the throttle actuator 3 is controlled normally in a step 202*a*.

When operation of the throttle actuator 3 is disabled, the throttle valve 2 is resiliently urged to move to the fully closed position under the effort of the return spring 5. However, there may arise such situation that the throttle valve 2 can not be moved to the fully closed position even when the operation of the throttle actuator 3 is stopped, because of a frictional engagement in a reduction gear train incorporated in the throttle actuator 3. To deal with this problem, it is known to dispose an electromagnetic clutch (not shown) between the shaft 4 of the throttle valve 2 and the throttle actuator 3 and disconnect the former from the latter by deenergizing the electromagnetic clutch upon occurrence of abnormality in the throttle valve control system to thereby allow the throttle valve 2 to assume the fully closed position under the action of the return spring 5. Further, when a failure takes place in operation for opening the throttle valve 2, fuel injection to all or some of the engine cylinders may be interrupted to thereby lower the engine output torque.

On the other hand, when a failure occurs in the fully closed state of the throttle valve 2 (i.e., when the throttle valve 2 can not be opened from the fully closed position), the engine operation stops spontaneously to inhibit the motor vehicle from further running. As the measures for coping with this problem, it can be conceived to mechanically couple the throttle valve 2 to the accelerator pedal 7 through manual operation or to provide throttle actuator systems in duplicate with one in redundancy.

As is apparent from the foregoing description, in the conventional throttle valve control system for the motor vehicle, the throttle actuator control can certainly be failsafed against failure in the opened position of the throttle valve (i.e., failure incurring runaway of the engine). However, for the failure occurring in the fully closed position of the throttle valve (i.e., failure disabling the running of the engine), there is known no remedy method which can be adopted practically and profitably from the standpoint of manipulation as well as the economical viewpoint. It goes without saying that the disability of running the motor vehicle due to such failure will incur unwanted situation in dependence on the place where the motor vehicle is driven. For example, in the course of driving the motor vehicle on an expressway, this sort of failure should positively be excluded.

SUMMARY OF THE INVENTION

In the light of the state of the art described above, it is an object of the present invention to provide an intake air flow control system for an internal combustion engine of a motor vehicle which system can ensure the running of a motor vehicle even upon occurrence of abnormality in the throttle control system inclusive of the throttle actuator at the fully closed position of the throttle valve.

In view of the above and other objects which will become apparent as description proceeds, there is provided according to an aspect of the present invention an intake air flow control system for an internal combustion engine of a motor vehicle, which system comprises an accelerator pedal depression sensor for detecting depression level of an accelerator pedal, a throttle actuator for regulating opening degree of a throttle valve in dependence on the depression level of the accelerator pedal, a bypass intake passage which bypasses an intake pipe of the engine at a location where the throttle valve is disposed, a bypass control valve installed in the bypass intake passage, the opening degree of the bypass control valve being controlled intrinsically in dependence on predetermined running states of the engine, an abnormality detecting means for detecting abnormality occurring in control of the throttle actuator, and means for controlling the opening degree of the bypass control valve in dependence on the depression level of the accelerator pedal in response to detection of abnormality occurring in the throttle valve control in the fully closed position of the throttle valve.

With the structure of the intake air flow control system described above, the motor vehicle can continue to run even upon occurrence of abnormality in the control Derformed by the throttle actuator in the fully closed state of the throttle valve by virtue of such feature that the bypass control valve is then controlled in dependence on the depression degree of the accelerator pedal.

The above and other objects, features and attendant advantages of the invention will better be understood by reading the following description of preferred embodiments thereof taken in conjunction with the drawings.

DESCRIPTION OF THE PREFERRED EMBODIMENTS

Now, the present invention will be described in detail in conjunction with preferred or exemplary embodiments thereof by reference to the drawings.

Figure 1:
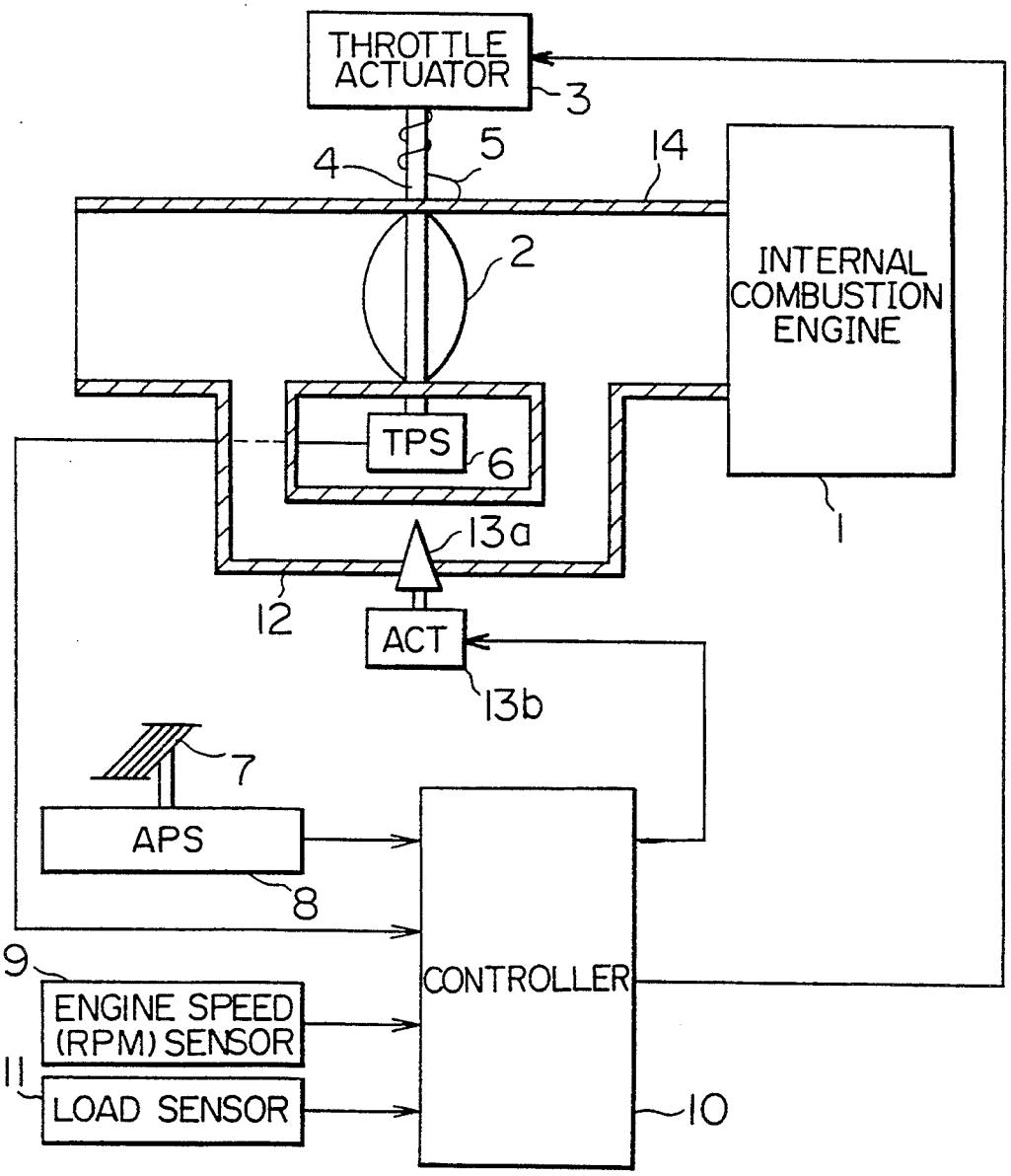
FIG. 1 is a block diagram showing generally a structure of an intake air flow control system for an internal combustion engine system of a motor vehicle according to an embodiment of the present invention.
Figure 2:
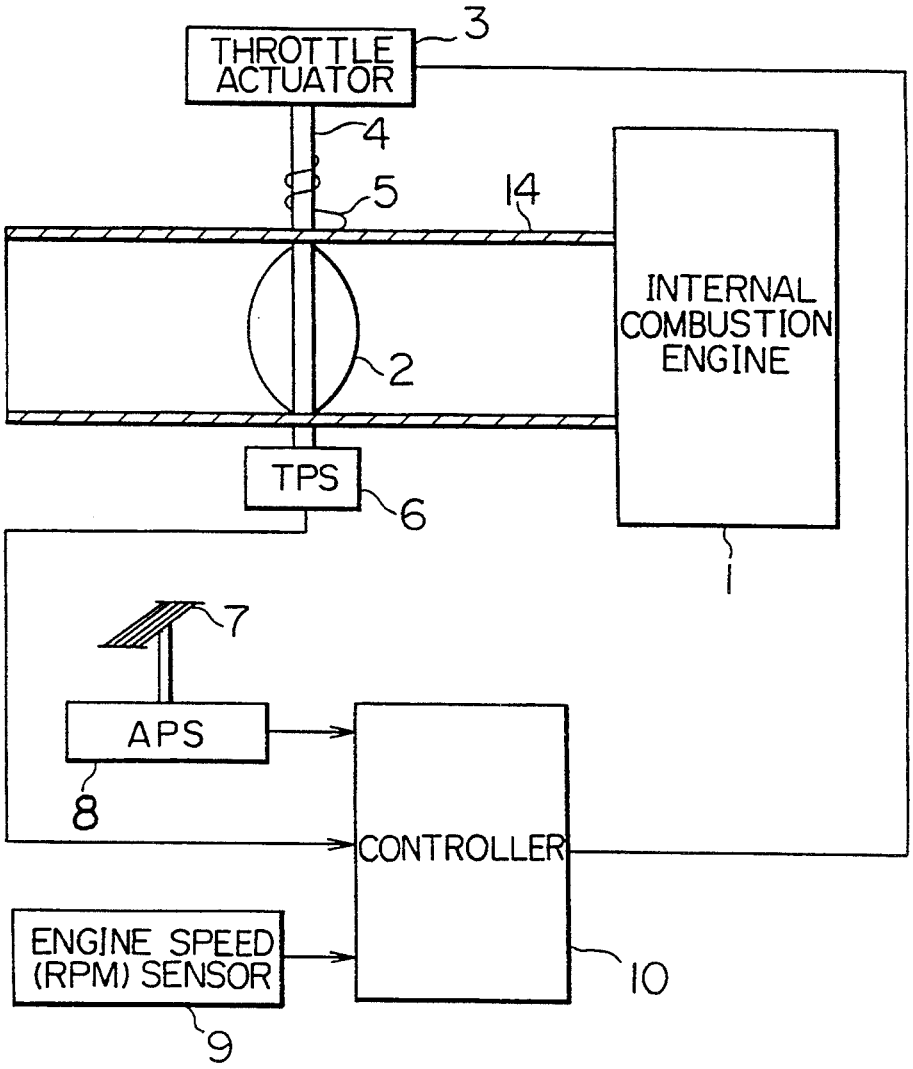
FIG. 2 PRIOR ART
FIG. 2 is a block diagram showing schematically a structure of an intake air flow control system for an engine of a motor vehicle known heretofore.

FIG. 1 is a block diagram showing generally a structure of an intake air flow control system for an internal combustion engine of a motor vehicle according to an embodiment of the invention. In this figure, the components which are same as or equivalent to those described hereinbefore in conjunction with the known system shown in FIG. 2 are denoted by like reference numerals and repeated description thereof is omitted. The intake air flow control system according to the instant embodiment of the invention differs from the conventional one shown in FIG. 2 in that there are additionally provided load sensors 11 (only one of which is shown) for generating signals representative of load states of engine make-up machines or accessories such as an air conditioner, a power steering system, various electric apparatuses and the like, a bypass passage 12 which is so disposed as to bypass the intake pipe 14 at a location where the throttle valve 2 is disposed, and a bypass control valve unit 13 for controlling the amount of air flowing through the bypass passage 12.

Figure 3:
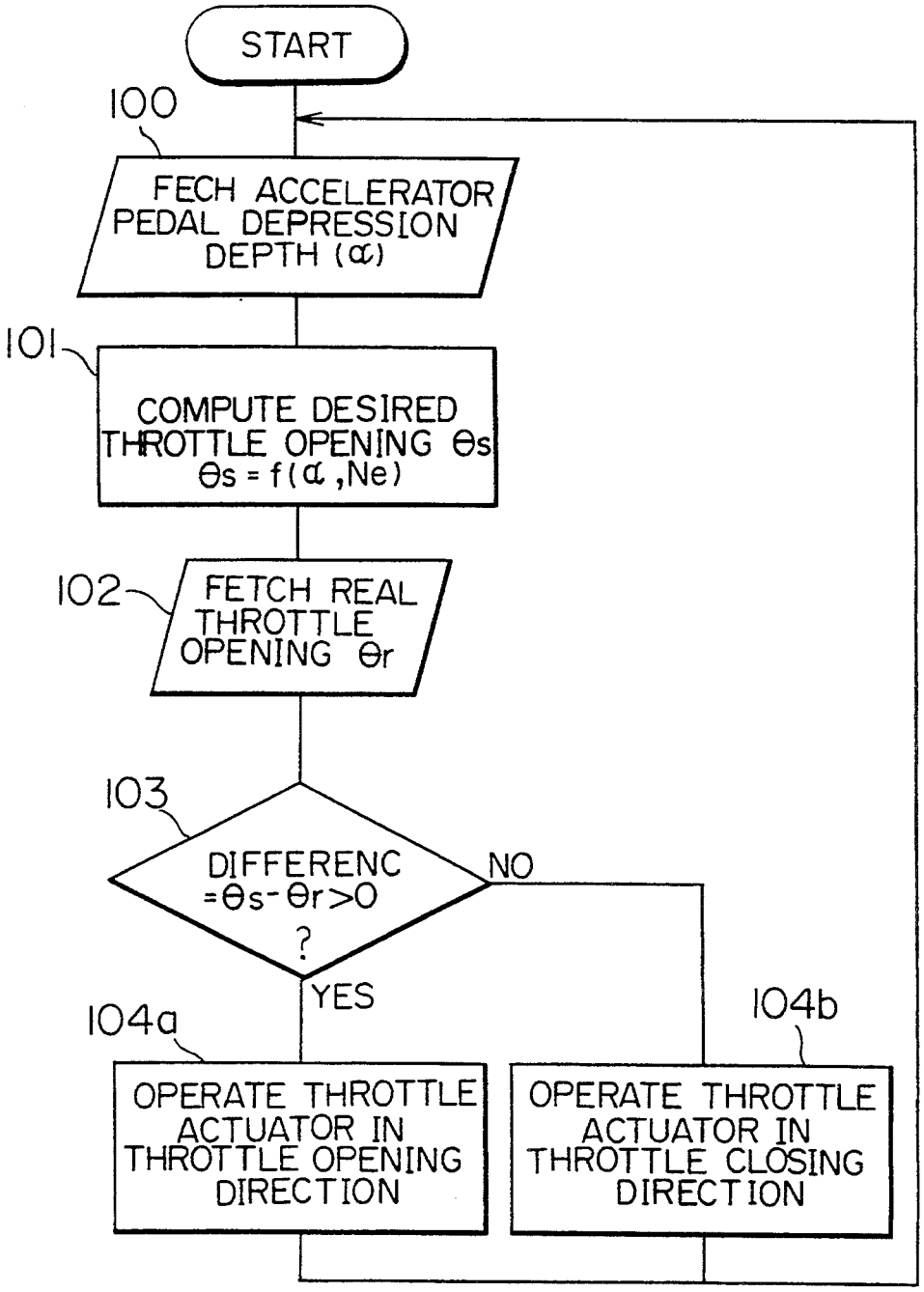
FIG. 3 is a flow chart for illustrating a procedure for controlling a throttle valve in the system shown in FIG. 2.
Figure 4:
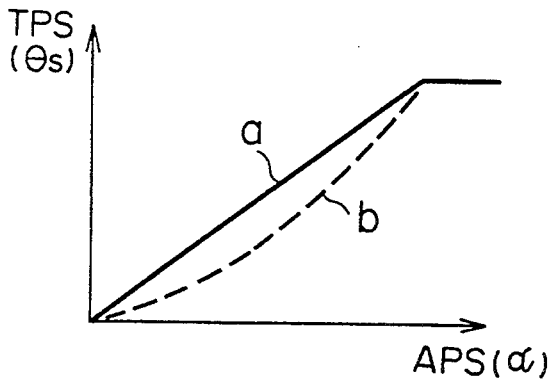
FIG. 4 is a view for illustrating graphically typical relations between desired throttle opening and accelerator pedal depression.
Figure 5:
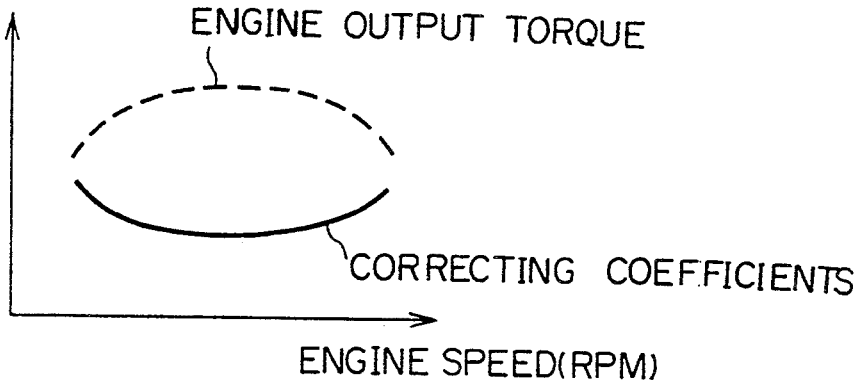
FIG. 5 is a view for illustrating graphically relations between engine output torque and engine rotation speed.

With the structure of the intake air flow control system described above, the control of the throttle actuator 3 is performed through a substantially same procedure as that described hereinbefore in conjunction with the flow chart shown in FIG. 3 (i.e., as in the case of the intake air flow control system known heretofore). However, in the case of the intake air flow control system according to the instant embodiment of the invention, the bypass passage 12 is additionally provided, wherein the air flow through the bypass passage 12 is regulated by the bypass control valve 13*a* whose opening is controlled by a valve actuator 13*b* under the control of the controller 10. Parenthetically, it is to be mentioned that provision of a bypass air flow control valve unit (13*a;* 13*b*) in a bypass passage for the purpose of controlling the idling speed (rpm) of the engine is known and adopted in some practical applications. Basic operation of such bypass air flow control valve unit is to control the opening of the bypass control valve 13*a* in an open loop in dependence on the load states of the engine accessories mentioned previously while realizing a feedback control of the engine speed (rpm) so that it assumes constantly a predetermined level or value (idling speed level) when the throttle valve 2 is fully closed (i.e., when the accelerator pedal is released).

With the present invention, it is contemplated to validate fail-safe operation as well as backup operation of the engine and hence the motor vehicle, when abnormality takes place in the throttle valve 2, the throttle actuator 3 and/or the control system therefor in the fully closed position of the throttle valve 2. This will be described below by reference to a flow chart shown in FIG. 7.

Figure 6:
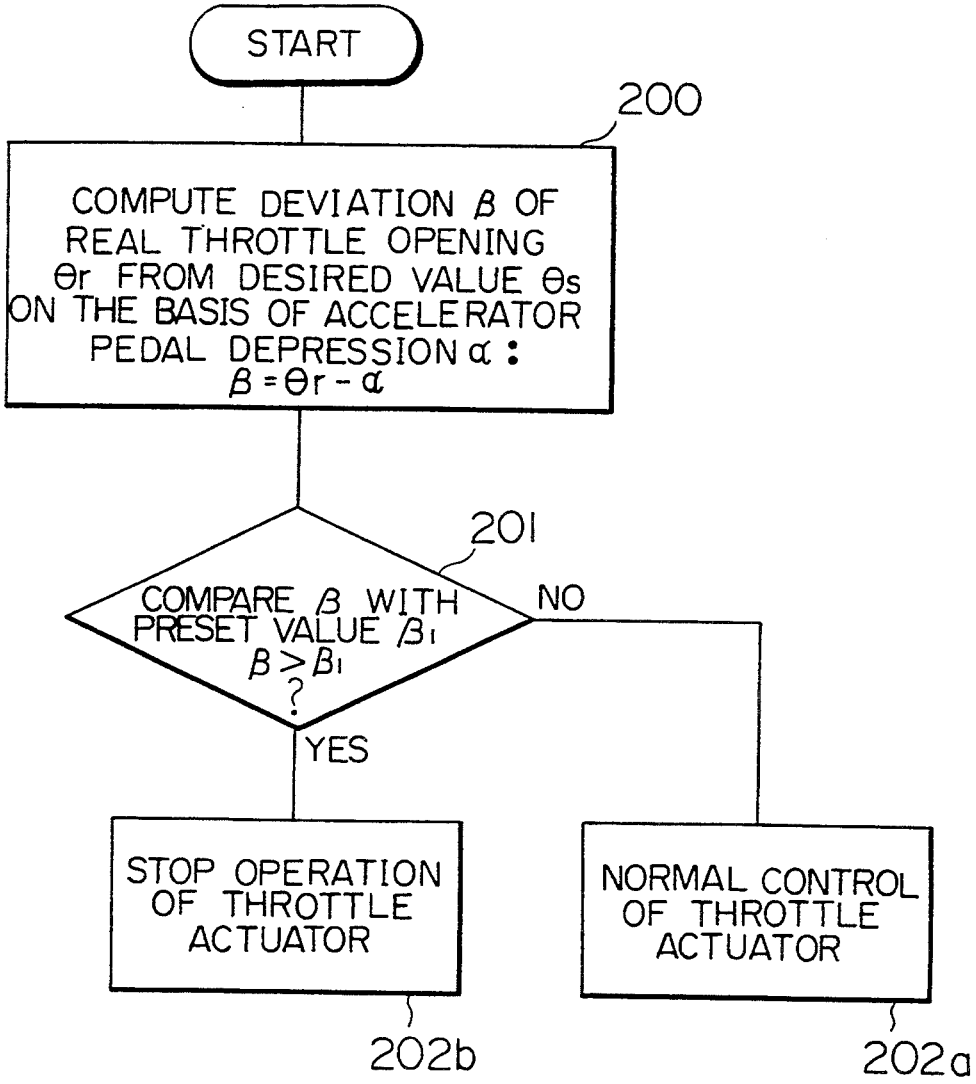
FIG. 6 is a flow chart for illustrating a procedure for making decision as to occurrence of abnormality in a throttle control and the measures to be taken in dependence on the results of the abnormality decision.
Figure 7:
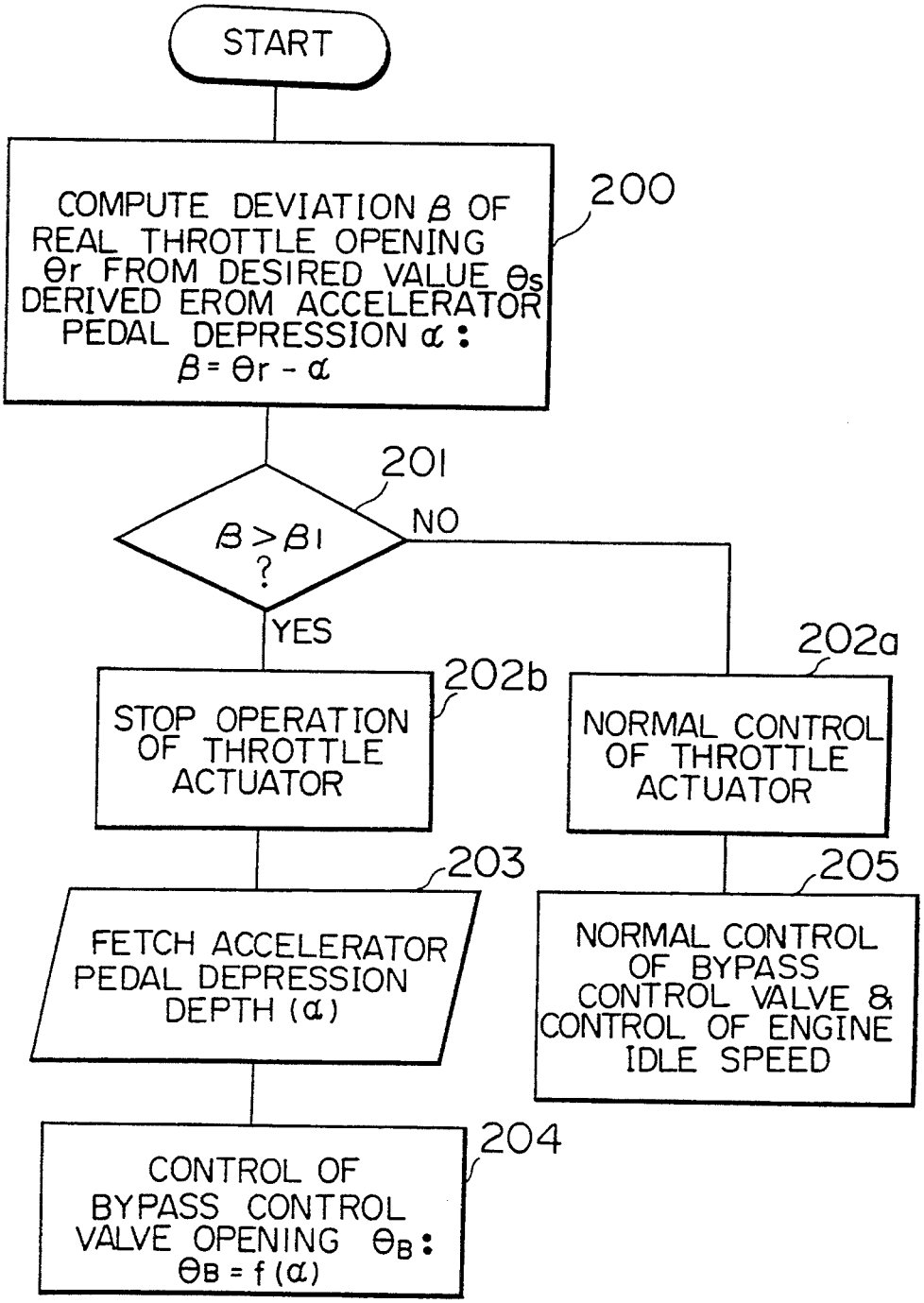
FIG. 7 is a flow chart for illustrating abnormality decision processing and subsequent processing according to an embodiment of the invention.
Figure 8:
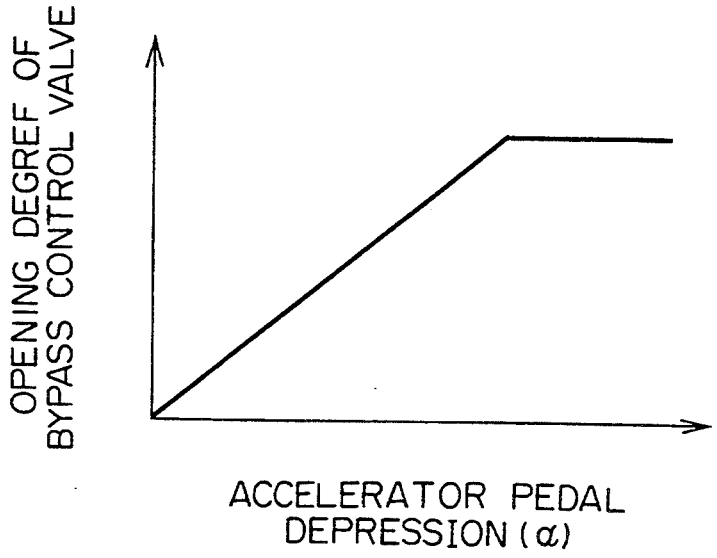
FIG. 8 is a view for graphically illustrating relation between accelerator pedal depression and opening degree of a bypass control valve in an intake air flow control system according to the invention.

Referring to FIG. 7, processing steps 200 to 202*a;* 202*b* are same as those described hereinbefore in conjunction with FIG. 6. According to the teachings of the present invention, the accelerator pedal depression $\alpha$ is fetched in a step 203 after operation of the throttle actuator 3 has been stopped upon occurrence of failure in the actuator or control system therefor in the fully closed state of the throttle valve (step 202*b*), whereon the opening $\theta_B$ of the bypass control valve 13 is controlled as a function of the accelerator pedal depression $\alpha$ in a step 204 in such a manner as illustrated graphically in FIG. 8. It goes without saying that so far as the throttle control system remains normal, the opening of the bypass control valve 13*a* is controlled as a function of the load states of the engine accessories mentioned previously under the control of the controller 10 independent of actuation or depression $\alpha$ of the accelerator pedal 7.

In the case of the intake air flow control system described above, it is assumed that abnormality of the throttle actuator 3 is decided on the basis of magnitude of difference $\beta$ between the accelerator pedal depression $\alpha$ and the real throttle opening $\theta_\gamma$. However, such abnormality decision may be made on the basis of a preestablished relation between the intake air flow of the engine 1 detected by an intake air flow sensor (not shown) and the depression depth $\alpha$ of the accelerator pedal or the desired throttle opening $\theta_S$. To this end, output signals of other appropriate sensors may be utilized. Besides, for dealing with such situation that the throttle control is disabled due to abnormality taking place in the controller 10, occurrence of abnormality may be monitored by an electronic circuit or microcomputer provided separately from the controller 10.

In consideration of the fact that when the bypass air flow is small, the running performance of the motor vehicle can not satisfactorily be assured by the backup operation performed by using the bypass passage 12 upon occurrence of failure in the throttle control system inclusive of the throttle actuator 3 in the fully closed state of the throttle valve 2, the flow section of the bypass passage 12 should be so selected that the amount of the bypass air flow is sufficient for the speed of the engine after the warming-up to attain a predetermined value, for example, of 2000 rpm at the least and preferably about 4000 rpm. Further, when the actuator **13*b* of the bypass control valve 13*a* is constituted by a stepping motor or a DC motor, the response of the actuator tends to be accompanied with a time lag, which involves a corresponding time lag in increasing the engine output torque by depressing the accelerator pedal 7**. Accordingly, suitable means should preferably be provided for increasing the air flow for the idle operation upon occurrence of abnormality when compared with that of the normal operation.

Many features and advantages of the present invention are apparent form the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to, falling within the scope of the invention.

We claim:

1. An intake air flow control system for an internal combustion engine of a motor vehicle, comprising:

accelerator pedal sensor means (8) for detecting an actuation level of an accelerator pedal;

throttle actuator means (3) for controlling an opening degree of a throttle valve (2) in dependence on the detected actuation level of said accelerator pedal;

a bypass intake passage (12) bypassing an intake pipe (14) of said engine at a location where said throttle valve is disposed;

bypass control valve means (**13*a***) installed in said bypass intake passage;

abnormality detecting means for detecting an abnormality occurring in the control performed by said throttle actuator means when the throttle valve is in a fully closed state; and means (**10, 13*b***) for controlling the opening degree of said bypass control valve in dependence on the detected actuation level of said accelerator pedal in response to a detection of abnormality in the control performed by said throttle actuator means, wherein said abnormality detecting means detects an abnormality based on a difference in magnitude between the actuation level of said accelerator pedal and a real opening degree of said throttle valve, in comparison with a predetermined value.

2. An intake air flow control system according to claim 1, wherein opening degree of said bypass control valve is ordinarily controlled in dependence on running states of said engine.

3. An intake air flow control system according to claim 1, wherein said abnormality detecting means detects abnormality in at least one of said throttle valve and said throttle actuator in the fully closed state of said throttle valve.

4. An intake air flow control system according to claim 2, further comprising means for detecting abnormality in operation of said control means to thereby control the opening degree of said bypass control valve.

5. An intake air flow control system according to claim 1, wherein said bypass control valve means and said bypass intake passage are additionally used for supplying intake air to said engine during idling.

* * * * *